US011311764B2

(12) United States Patent
Ishiguro et al.

(10) Patent No.: US 11,311,764 B2
(45) Date of Patent: Apr. 26, 2022

(54) SACROILIAC JOINT EXERCISE ASSISTANCE DEVICE IN LATERAL DECUBITUS POSITION

(71) Applicant: Takashi Ishiguro, Kanagawa (JP)

(72) Inventors: Takashi Ishiguro, Kanagawa (JP); Keisuke Ishiguro, Kanagawa (JP)

(73) Assignee: Takashi Ishiguro, Kanagawa (JP)

( * ) Notice: Subject to any disclaimer, the term of this patent is extended or adjusted under 35 U.S.C. 154(b) by 174 days.

(21) Appl. No.: 16/316,226

(22) PCT Filed: Jul. 14, 2017

(86) PCT No.: PCT/JP2017/025750
§ 371 (c)(1),
(2) Date: Jan. 8, 2019

(87) PCT Pub. No.: WO2018/012620
PCT Pub. Date: Jan. 18, 2018

(65) Prior Publication Data

US 2019/0299044 A1 Oct. 3, 2019

(30) Foreign Application Priority Data

Jul. 14, 2016 (JP) ..... JP2016-152316

(51) Int. Cl.
*A63B 21/00* (2006.01)
*A61H 1/02* (2006.01)
*A63B 23/04* (2006.01)

(52) U.S. Cl.
CPC ..... *A63B 21/00181* (2013.01); *A61H 1/02* (2013.01); *A61H 1/0244* (2013.01);
(Continued)

(58) Field of Classification Search
CPC ..... A63B 21/00181; A63B 21/00185; A63B 21/00178; A63B 21/00058;
(Continued)

(56) References Cited

U.S. PATENT DOCUMENTS 5,035,234 A * 7/1991 Forsythe ..... A63B 23/0482 601/24
5,162,039 A * 11/1992 Dahners ..... A61F 5/04 602/23
(Continued)

FOREIGN PATENT DOCUMENTS

CN 2032049 U 2/1989
CN 101138533 A 3/2008
(Continued)

OTHER PUBLICATIONS

Extended European Search Report dated Feb. 3, 2020 in corresponding European Patent Application No. 17827743.0.
(Continued)

*Primary Examiner* — Joseph D. Boecker
*Assistant Examiner* — Brian T Khong
(74) *Attorney, Agent, or Firm* — McCarter & English, LLP; David G. Conlin

(57) ABSTRACT

An exercise assist device transitively moves a sacroiliac joint in a lateral decubitus position. The following description is provided in the context of a left lateral decubitus position. The upper right leg is placed on a stand in the lateral decubitus position, and the upper right leg is then extended transitively backward with a sacral area supported by a sacrum support pad. Since a posterior side of a lower left sacroiliac joint is slightly opened, a sacrum slides backward via a right hip joint. This improves mobility of the lower left sacroiliac joint.

5 Claims, 6 Drawing Sheets

(52) U.S. Cl.
CPC ..... *A63B 21/4033* (2015.10); *A63B 23/04* (2013.01); *A63B 23/0488* (2013.01); *A61H 2001/0248* (2013.01); *A61H 2201/164* (2013.01); *A61H 2201/1626* (2013.01); *A61H 2203/0475* (2013.01); *A63B 2208/0266* (2013.01)

(58) Field of Classification Search
CPC ..... A63B 21/4023; A63B 21/4009; A63B 21/4011; A63B 21/4013; A63B 21/4015; A63B 21/4025; A63B 21/4034; A63B 21/4039; A63B 21/4047; A63B 21/4049; A63B 23/04; A63B 23/0405; A63B 23/0482; A63B 23/0488; A63B 23/0494; A63B 23/08; A63B 23/085; A63B 2208/0266; A63B 21/002; A63B 21/0023; A63B 21/065; A63B 21/068; A63B 69/0057; A63B 69/0059; A63B 69/0062; A63B 69/0064; A63B 71/0054; A63B 2071/0072; A61H 1/02; A61H 1/0203; A61H 1/0207; A61H 1/0211; A61H 1/0214; A61H 1/0237; A61H 1/0244; A61H 1/0255; A61H 2001/0248; A61H 2001/0251; A61H 2201/1623; A61H 2201/1626; A61H 2201/164; A61H 2201/1642; A61H 2203/0475; A61H 2203/0431; A61H 2203/045; A61H 2203/0462; A61H 2201/0142; A61H 2201/1253; A61H 2201/1215; A61H 2201/1269; A61H 2201/1628; A61H 2201/163; A61H 2201/1676; A61H 2203/0443; A61H 2205/088; A61H 2205/10; A61G 13/12; A61G 13/123; A61G 13/1245; A61G 13/125; A61G 13/0081; A61G 13/1225; A61G 2200/322
See application file for complete search history.

(56) References Cited

U.S. PATENT DOCUMENTS 5,295,936 A * 3/1994 Perry, Jr. ..... A63B 21/00047 482/134
5,390,383 A 2/1995 Carn
5,608,934 A * 3/1997 Torrie ..... A61G 13/0036 5/624
5,645,079 A * 7/1997 Zahiri ..... A61F 5/3769 128/882
6,003,175 A * 12/1999 Couch ..... A61G 7/0755 378/177
6,298,507 B1 * 10/2001 Clyburn ..... A61G 13/12 248/445
6,595,904 B1 7/2003 Staffa
6,692,451 B2 * 2/2004 Splane, Jr. ..... A61G 13/009 128/845
7,341,565 B2 * 3/2008 Splane, Jr. ..... A61H 1/001 601/24
8,397,731 B1 * 3/2013 Perper ..... A61G 15/12 128/845
2002/0056161 A1 * 5/2002 Falbo, Sr. ..... A61B 6/502 5/601
2002/0128577 A1 * 9/2002 Smart ..... A61G 13/0045 602/36
2003/0135137 A1 * 7/2003 Splane, Jr. ..... A61H 1/0218 601/24
2003/0178027 A1 * 9/2003 DeMayo ..... A61G 13/0081 128/845
2004/0133979 A1 * 7/2004 Newkirk ..... A61F 5/3761 5/600
2006/0293156 A1 * 12/2006 Trees ..... A63B 21/068 482/148
2007/0161935 A1 * 7/2007 Torrie ..... A61G 13/0036 602/32
2007/0265635 A1 * 11/2007 Torrie ..... A61B 17/66 606/105
2008/0096744 A1 * 4/2008 Perry, Jr. ..... A61H 1/0292 482/144
2009/0124865 A1 5/2009 Kiernan
2009/0227911 A1 9/2009 Srivastava et al.
2010/0004577 A1 * 1/2010 Yasuhara ..... B25J 9/0006 602/23
2010/0113233 A1 * 5/2010 Chen ..... A63B 21/4047 482/133
2011/0143898 A1 * 6/2011 Trees ..... A63B 23/0405 482/142
2012/0240938 A1 9/2012 Pamichev
2012/0318278 A1 * 12/2012 Aboujaoude ..... A61G 7/1096 128/845
2014/0059773 A1 * 3/2014 Carn ..... A61G 13/123 5/624
2014/0188129 A1 * 7/2014 Kang ..... A61G 13/125 606/130
2014/0212243 A1 * 7/2014 Yagi ..... A61H 1/024 414/2
2018/0098905 A1 * 4/2018 Nelson ..... A63B 21/4047

FOREIGN PATENT DOCUMENTS

| | | | |
|---|---|---|---|
| FR | 1603139 | A | 3/1971 |
| FR | 2301225 | A1 | 9/1976 |
| JP | 52-104291 | | 8/1977 |
| JP | 2001-178756 | A | 7/2001 |
| JP | 2005-514986 | A | 5/2005 |
| JP | 2011-512166 | A | 4/2011 |
| WO | 03/026551 | A1 | 4/2003 |
| WO | 2008/150731 | A1 | 12/2008 |
| WO | 2009/110995 | | 9/2009 |

OTHER PUBLICATIONS

Maigne et al., "So-Called Sacroiliac Joint Techniques," Diagnosis and Treatment of Pain of Vertebral Origin, CRC Press: 481 488 (2005).
DonTigny, "A detailed and critical biomechanical analysis of the sacroiliac joints and relevant kinesiology: the implications for lumbopelvic function and dysfunction," Movement, Stability & Lumbopelvic Pain. Churchill Livingstone: 265-278 (2007).
Dijkstra, "Basic Problems in the Visualization of the Sacroiliac Joint," Movement, Stability & Lumbopelvic Pain. Churchill Livingstone: 299-310 (2007).
Lee et al., "An Integrated Therapeutic Approach to the Treatment of Pelvic Girdle Pain," Movement, Stability & Lumbopelvic Pain. Churchill Livingstone: 621-638 (2007).
Schwarzer et al.,"The Sacroiliac Joint in Chronic Low Back Pain," Spine 20(1): 31-37 (1995).
Bernard, Jr. et al., "The Sacroiliac Joint Syndrome: Pathophysiology, Diagnosis, and Management," The Adult Spine: Principles and Practice: 2343-2366 (1997).
Ishiguro, "O12-3 trial of new stretching exercise for treating sacroiliac joint disorder," Ishiguro Orthopaedic Clinic, Proceedings of the 29th Annual Meeting of the Japanese Clinical Orthopaedic Association (JCOA), p. 161, Jul. 17 and 18, 2016.
Ishiguro, "Feb. 4, 15 trial of new mobilization for treating sacroiliac joint disorder," Ishiguro Orthopaedic Clinic, Program and Proceedings of the 24th Annual Meeting of the Japanese Society of Lumbar Spine Disorders, p. 355, Sep. 2 and 3, 2016.
Setsuo Hakata, AKA Arthrokinematic Approach Hakata-method, Second Edition, Ishiyaku-Shuppan, p. 85, 2007.
International Search Report issued in PCT/JP2017/025750 dated Sep. 19, 2017.
International Preliminary Report on Patentability issued in PCT/JP2017/025750 dated Jan. 15, 2019.

(56) References Cited

OTHER PUBLICATIONS

Office Action dated Jun. 3, 2020 in corresponding Chinese Patent Application No. 201780040960.2.
Office Action dated Mar. 29, 2021 in corresponding Chinese Patent Application No. 201780040960.2.
Chinese Office Action for Application No. 201780040960.2, dated Aug. 6, 2021, 12 pages.

* cited by examiner

SACROILIAC JOINT EXERCISE ASSISTANCE DEVICE IN LATERAL DECUBITUS POSITION

TECHNICAL FIELD

The present invention relates to an exercise assist device which puts a sacroiliac joint through transitive movement in a lateral decubitus position.

BACKGROUND ART

Conventionally, exercise assist devices for correcting tilts of a pelvis and a sacroiliac joint have been operated in a supine position or in a seated position.

CITATION LIST

Non-Patent Literature

[Non-Patent Literature 1]
Setsuo Hakata (eds): AKA Arthro-Kinematic Approach Hakata-method, Second Edition, Ishiyaku-Shuppan, Tokyo, 2007

SUMMARY OF INVENTION

Technical Problem

These devices have the following drawback.

Conventionally, devices for correcting a pelvic tilt have been used in a supine position or in a seated position. Unfortunately, in a case where a sacroiliac joint is in an abnormal condition on its joint surface, these devices cannot provide sufficient mobility in the supine position or in the seated position. The present invention has been attained to eliminate the above drawback.

Solution to Problem

In order to solve the above problem, an exercise assist device includes a member adapted to support a leg in a lateral decubitus position, the exercise assist device providing movement of a sacroiliac joint by extending the leg transitively.

Advantageous Effects of Invention

Assuming a lateral decubitus position applies load to a lower sacroiliac joint and slightly opens a posterior area of a joint surface of the lower sacroiliac joint. Since a contact area of the joint surface of the lower sacroiliac joint is limited to an anterior area of the lower sacroiliac joint, swinging a leg backward transitively causes extension of a corresponding hip joint, thus sliding the sacrum backward. This exercise improves mobility of the lower sacroiliac joint.

DESCRIPTION OF EMBODIMENTS

The following will describe the best mode for carrying out the present invention.

The following will describe Example in the context of a left lateral decubitus position. A human subject is made relaxed in a lateral decubitus position. While a sacral area of the human subject is supported with a sacrum support pad (2), an upper leg is placed on a stand (1), and then, a right hip joint (10*a*) is gently extended backward transitively.

During the use of an exercise assist device, this motion goes on for five to six iterations, and the motion of gently extending a hip joint on the other side is similarly made for five to six iterations while the sacral area is supported.

[Exercise Assist Device]

The following will describe an exercise assist device in detail with reference to the drawings. As illustrated in FIGS. 1, 2, 5, and 6, an exercise assist device is a device for assisting a human subject in performing the exercise of moving a sacroiliac joint through movement of an upper leg of the human subject in a lateral decubitus position from a relaxed position to a backward position (toward his or her back) without exercise of voluntary muscles of the human subject in the lateral decubitus position (that is, in a passive or transitive manner for the human subject). Here, during the use of the exercise assist device, the human subject assumes a lateral decubitus position, turning either side of his or her body on which the human subject has a discomfort (e.g., pain and numbness) downward.

Figure 2:
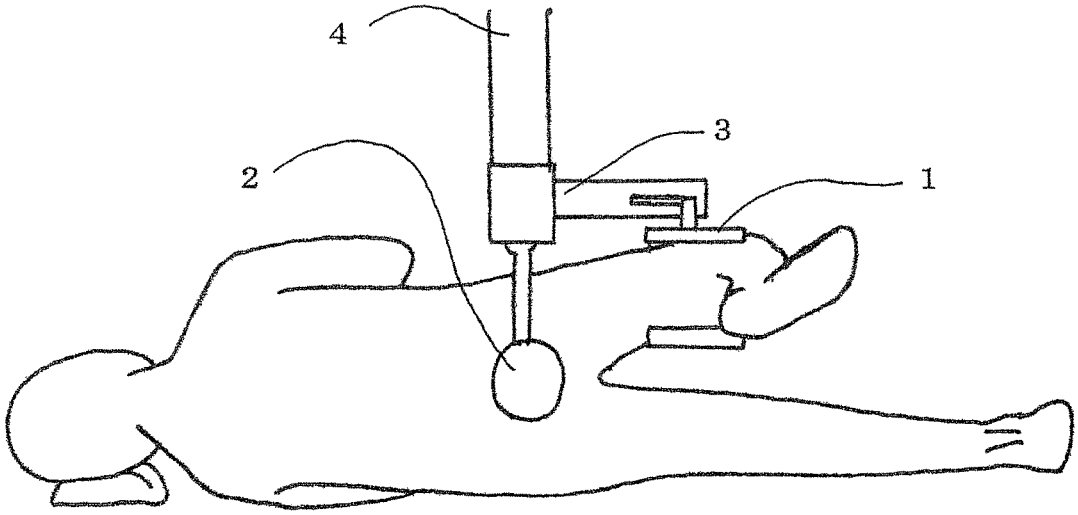
FIG. 2 is a rear view of an embodiment of the present invention (after operation).
Figure 3:
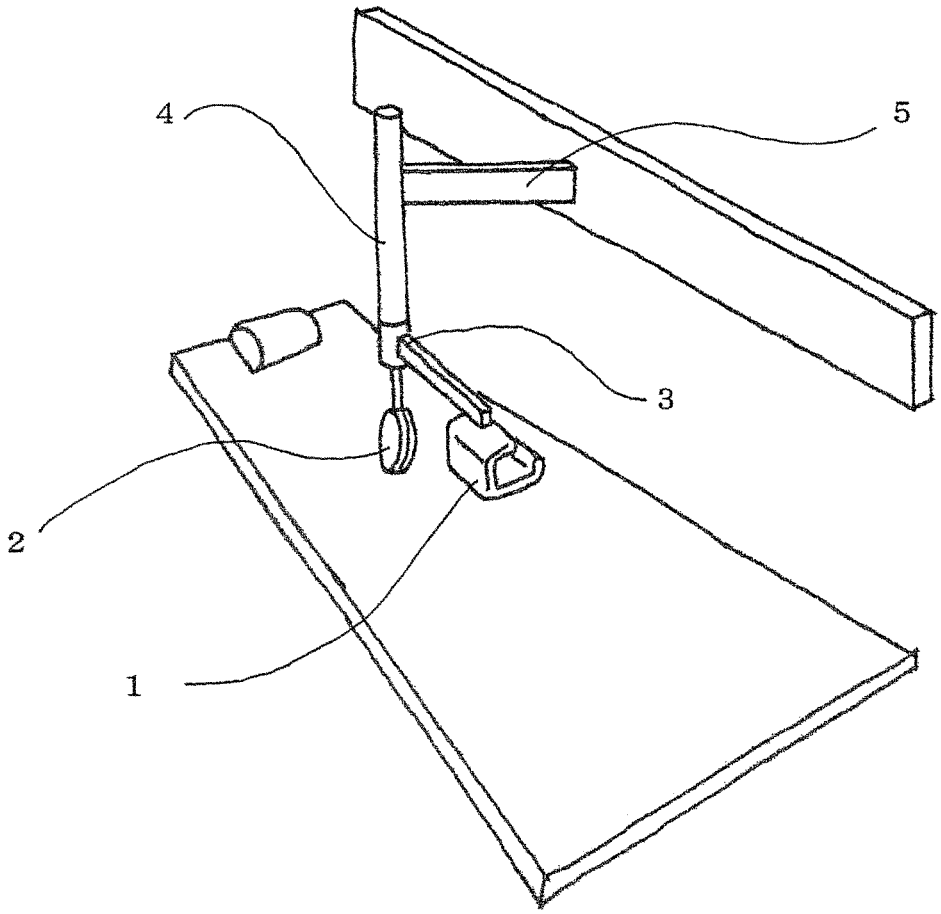
FIG. 3 is a perspective view of the present invention.
Figure 4:
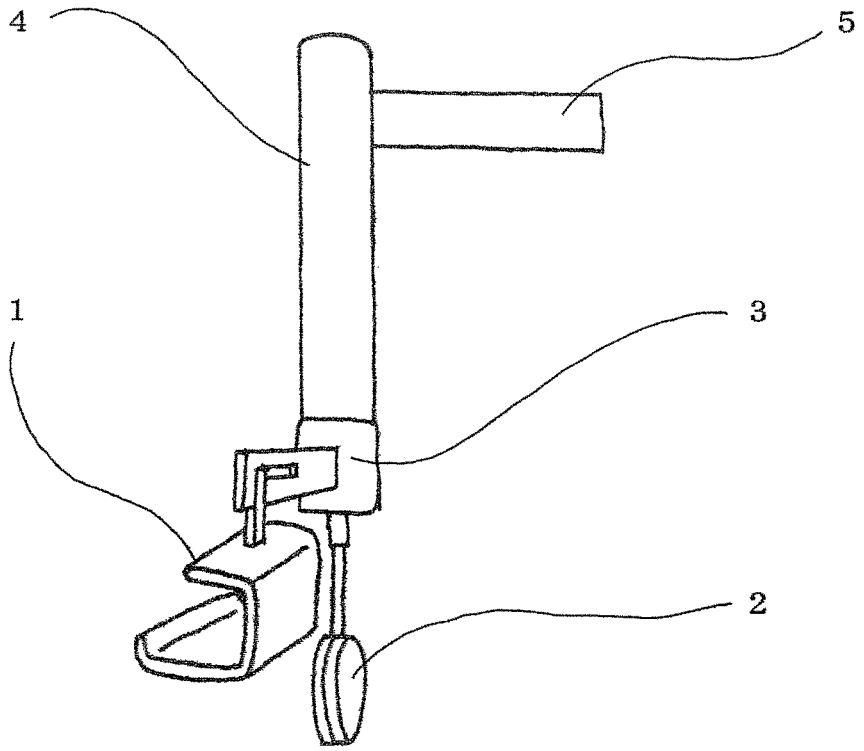
FIG. 4 is a specific and perspective view of the present invention.
Figure 5:
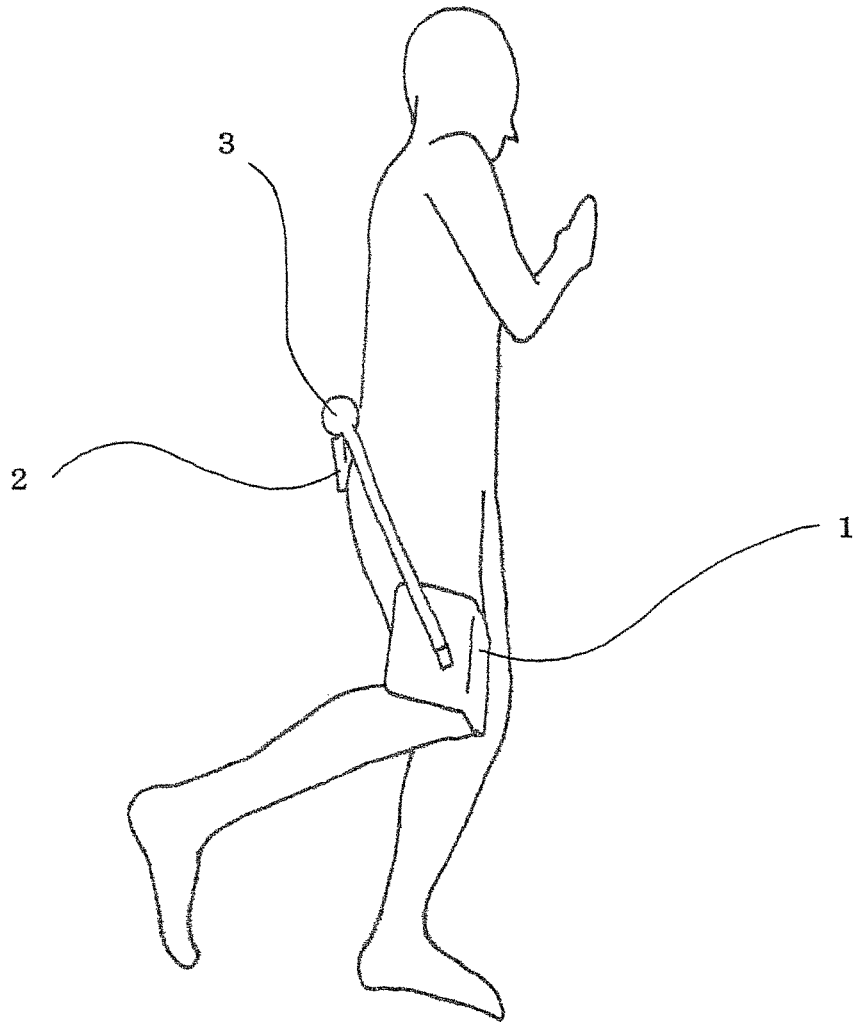
FIG. 5 is a plan view during the implementation of the present invention (before operation).
Figure 6:
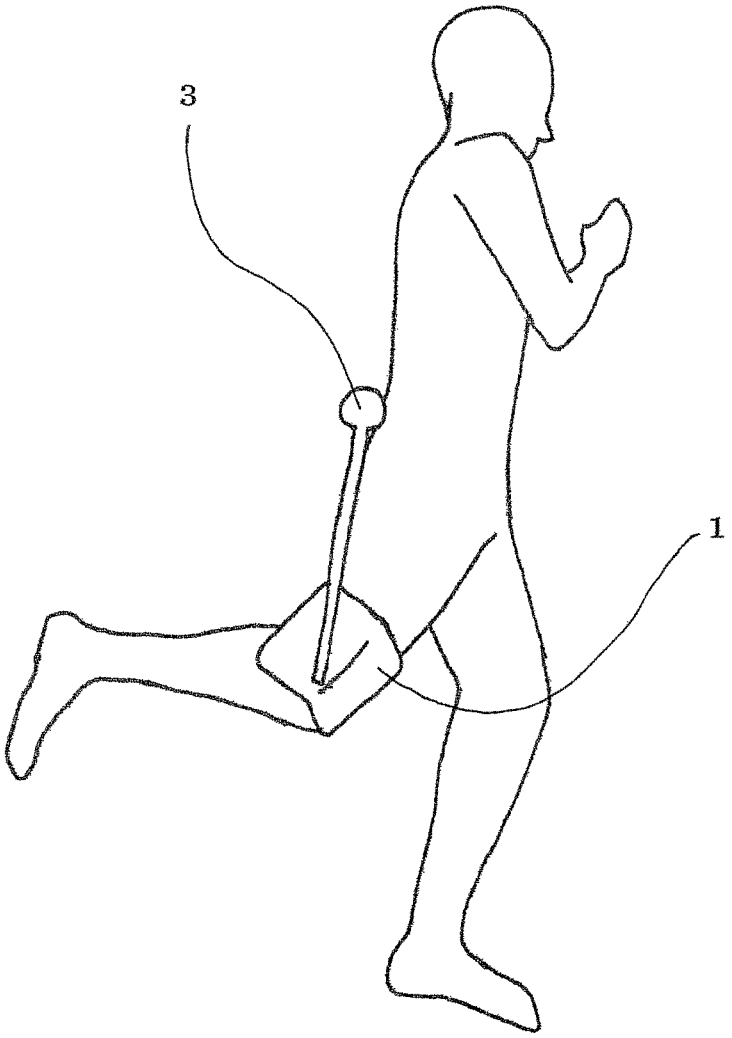
FIG. 6 is a plan view during the implementation of the present invention (after operation).

As illustrated in FIGS. 3 and 4, the exercise assist device includes a leg support stand (stand) 1, a sacrum support pad (pad) 2, a movable arm 3, a strut 4, and a connection frame 5 with respect to a wall surface. That is, an exercise assist device according to an embodiment is a combination of members indicated by reference numerals 1 to 5 in FIGS. 1 to 6. FIG. 3 illustrates the arrangement of the exercise assist device in a case where a left leg of a human subject who assumes a lateral decubitus position by lying on his or her right side is to be placed on the stand 1. FIG. 4 illustrates the arrangement of the exercise assist device in a case where a right leg of a human subject who assumes a lateral decubitus position by lying on his or her left side is to be placed on the stand 1. Thus, the stand 1 is able to pivot 360 degrees in a horizontal direction in a state in which the stand 1 is fixed to the wall surface via the strut 4. FIG. 4 illustrates an enlarged view of the exercise assist device to explain particularly how the stand 1 is connected to the arm 3.

Figure 1:
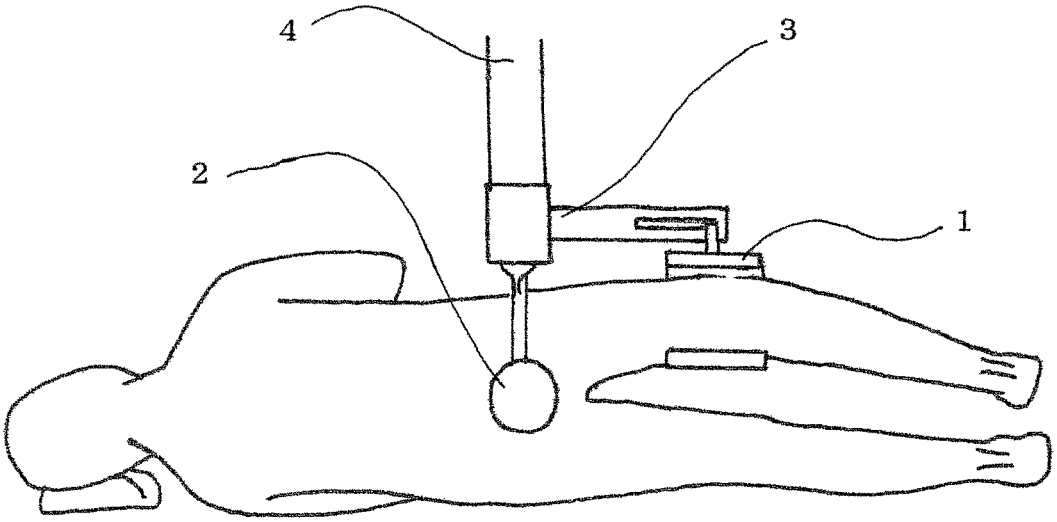
FIG. 1 is a rear view of an embodiment of the present invention (before operation).

As illustrated in FIGS. 3 and 4, the arm 3 maintains its position so as to be substantially parallel to the wall surface in a state in which no external force is applied to the arm 3. As illustrated in FIG. 1, when the right leg of the human subject who assumes a lateral decubitus position by lying on his or her left side is placed on the stand 1, the right leg of the human subject is lifted externally to his or her body axis. As illustrated in FIG. 1, when the exercise assist device is in use, the pad 2 supports a lumbar area (particularly an area corresponding to the sacrum) of the human subject behind his or her back, and the stand 1 supports an area extending from a lower region of his or her thigh to his or her knee at its front part. That is, motions of the human subject in the anterior-posterior direction are restricted by the exercise assist device (also see FIG. 5).

Figure 7:
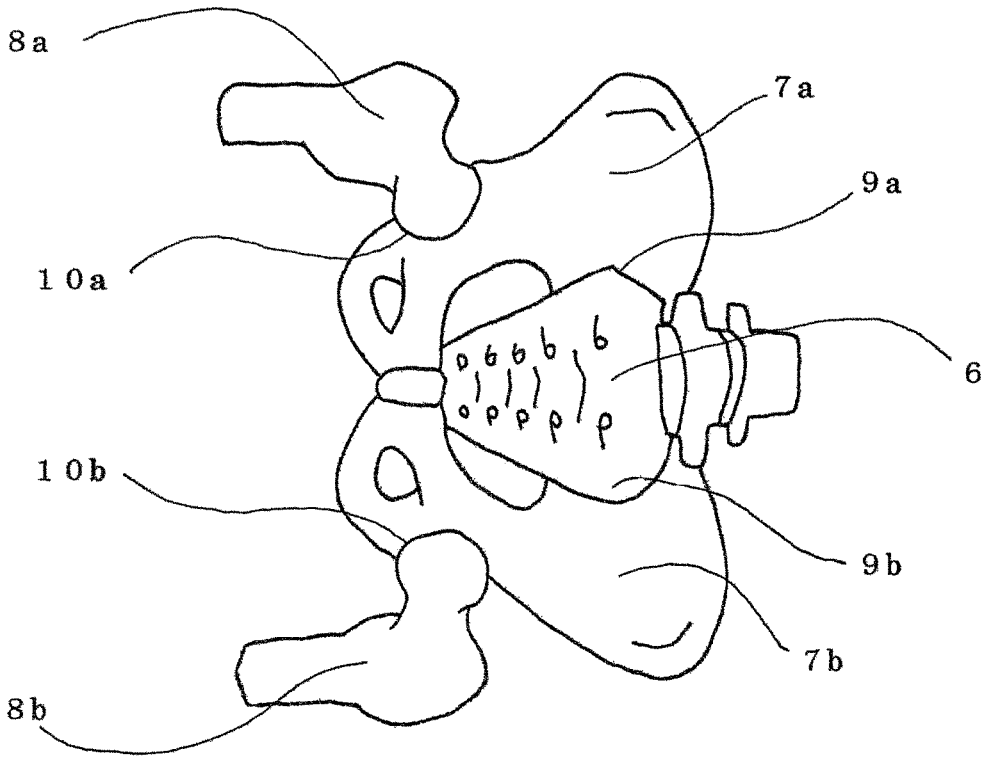
FIG. 7 is a front view of a sacroiliac joint of a user in a lateral decubitus position.

When the stand 1 in the state illustrated in FIG. 1 is moved toward the back of the human subject, the thigh of the human subject is extended toward the back of the human subject as illustrated in FIG. 2. As the thigh is extended toward the back, the sacrum returns to a normal position. The movements in the area extending from the thigh to the lumbar area in the human subject at this time will be described with reference to FIG. 7.

When a human subject assumes a left lateral decubitus position, load is applied to a left iliac bone 7*b*. This causes a left end of the left iliac bone 7*b* of the human subject to be pushed toward the anterior of the human subject, and also causes a right end of the left iliac bone 7*b* to be pushed toward the posterior of the human subject. This partially keeps the sacrum 6 (posterior-side portion of the sacrum 6) from contact with a vicinity of the right end of the left iliac bone 7*b*. In this state, when a right thigh is moved toward the back by use of the exercise assist device, a right iliac bone 7*a* moves toward the back. At this time, with movement of the right iliac bone 7*a*, the sacrum 6 partially losing contact with the left iliac bone 7*b* (specifically, the posterior-side portion of the sacrum 6 losing contact with the left iliac bone 7*b*) moves toward the back to return to a normal position. With the sacrum 6 having returned to a normal position from a position before use of the exercise assist device, the discomfort of the human subject is eliminated. The elimination of such a discomfort allows the human subject to recover a normal movement of the left body (not limited to the lumbar area and legs). The descriptions with reference to FIGS. 1 to 7 have taken, as an example, a case in which a thigh of a human subject is moved to a position closer to his or her back than his or her body axis. However, the exercise assist device capable of carrying out the method of improving movement of the sacroiliac joint (described later herein) is a device for assisting a human subject in moving his or her thigh from its initial position (position while the human subject is in a relaxed state) toward his or her back.

A force to move the stand 1 serves as a force which causes the arm 3 to pivot about the strut 4. Such a force is produced by the driving operation of a motor (not illustrated) which is provided in the strut 4 or in the arm 3 or is produced by man power by which the arm 3 or (any portion of) a leg of a human subject is moved toward his or her back. Thus, the exercise assist device is a device for assisting the human subject in moving the leg placed on the stand 1 toward his or her back, without exercise of voluntary muscles of the human subject (i.e., passively (i.e., transitively) for the human subject). Note that with bending and straightening of a thigh (hip joint) of the human subject in the lateral decubitus position, the arm 3 (and the stand 1) slightly moves up and down.

The strut 4 is extendable (not illustrated). For example, before the right leg of the human subject is placed on the stand 1, the strut 4 is extended, and after the right leg of the human subject has been placed on the stand 1, the strut 4 is retracted. This lifts the right leg of the human subject externally to his or her body axis. As illustrated in FIG. 4, the stand 1 slides with respect to the arm 3 to a different position to conform to a distance, varying by human subject, from the sacrum to the knee joint. As is clear from FIG. 5, the right knee of the human subject can be bent and straightened in a state in which the right knee is placed on the stand 1.

The pad 2 includes, on one side or both sides thereof, a human subject's back supporting surface. The pad 2 including, on one side thereof, the human subject's back supporting surface can rotate 360 degrees in a horizontal direction. This arrangement allows the human subject's back supporting surface to face the back of the human subject in any of the following cases: a case when the stand 1 points in a direction in which the stand 1 supports the left leg (see FIG. 3) and a case when the stand 1 points in a direction in which the stand 1 supports the right leg (see FIG. 4).

In FIGS. 3 and 4, the stand 1 (and the arm 3) and the pad 2 are connected to the strut 4 which extends in a direction substantially orthogonal to the body axis of the human subject. However, the strut 4 can be connected directly to the ceiling without the use of the connection frame 5 between the strut 4 and the ceiling. Alternatively, the strut 4 can be connected directly to the wall surface without the use of the connection frame 5 between the strut 4 and the wall surface. The stand 1 and the pad 2 do not necessarily have to be supported by one strut. For example, the stand 1 and the pad 2 can be supported by two respective struts. Other modified form of the device illustrated in FIGS. 3 and 4 is, for example, a device which is integral with a bed, in which the connection frame 5 is connected to somewhere on the bed (for example, a side on which a human subject's head is rest). Such a modified device can be used in any place where there is a room for the bed.

[Method of Improving Movement of Sacroiliac Joint]

In order to achieve the same object as that of the exercise assist device, an embodiment of the present invention provides a method of improving movement of a sacroiliac joint (named "Swing-Ishiguro method"), which method encompasses putting a human subject in a state of assuming a lateral decubitus position, turning either side of his or her body on which the human subject has a discomfort downward, through passive movement of his or her upper thigh toward his or her back. In other words, this method can be a method to be carried out regardless of whether a human subject is assisted by a device, and more specifically can be a method to be carried out by use of the exercise assist device, a method including steps to be all carried out manually by one or more persons, or a method to be carried out by use of a device(s) and a tool(s) other than the exercise assist device.

The following will describe the above method, taking as an example a case where a medical practitioner carries out the Swing-Ishiguro method on a patient who complains of a discomfort on a left side of his or her body. First, the patient is made lie on his or her left side on an examination table to assume a lateral decubitus position, and is made relaxed. The upper body of the patient is twisted to make his or her right shoulder (upper shoulder) closer to the examination table. The medical practitioner supports the patient's sacrum with one hand and lifts the right leg of the patient who is releasing tension of the muscles with the other hand slightly above the examination table. The right leg of the patient who is releasing tension of the muscles is situated at a position closer to the patient's anterior than the patient's body axis. From this state, the medical practitioner performs a swing of extending the right leg of the patient toward the patient's back (backward) and then returning it to its initial position, while the patient remains in a relaxed state (in a state in which the patient is releasing tension of the muscles). The medical practitioner repeats the swing five to six times. Optionally, the patient turns on his or her opposite position, and the medical practitioner performs the swing on the patient's left leg.

The medical practitioner extends the patient's leg while gently applying to the patient's leg only a force required to carry the patient's leg toward the patient's back (that is, the medical practitioner assists in moving the patient's leg toward the patient's back). Then, the medical practitioner stops applying the force at a position where the medical practitioner has experienced a resistance during the carriage of the patient's leg toward the patient's back, and then returns the patient's leg to its initial position. The position where the medical practitioner has experienced a resistance varies from patient to patient depending on, for example, stiffness of a patient's hip joint.

Assuming that one motion is a back-and-forth motion of a patient's leg between the position in a relaxed state and the position where the medical practitioner has experienced a resistance, the medical practitioner performs five to six iterations of the one motion within about 5 to 15 seconds (more specifically, 5, 6, 7, 8, 9, 10, 11, 12, 13, 14, or 15 seconds). This also applies to the stand 1 in the aforementioned device. The stand 1 performs five to six iterations of the one motion within about 5 to 15 seconds. The above-described duration of the five to six iterations of the one motion is merely an example and can be lengthened or shortened according to a patient's condition.

Twisting the upper body of the patient applies a heavier load to the left iliac bone of the patient than simply assuming a lateral decubitus position, thus allowing the posterior side of the left sacroiliac joint to be further opened. Therefore, twisting the upper body of the patient is believed to enhance the effectiveness of the above-described motion (movement and repositioning of the sacrum).

It should be noted that the above-described method aims at allowing a human subject to perform an exercise assisted by use of an exercise assist device. Such an exercise cannot be performed by a human subject by himself or herself and requires assistance from merely another person. Thus, another person who carries out the method (who assists the human subject) can be any person other than a medical practitioner.

[Confirmation of Effectiveness]

The Swing-Ishiguro method was carried out on 2282 patients who complain of pain and numbness as symptoms. Some of these patients had complained of these symptoms for many years and had received treatments in medical institutions, but had never experienced improvement of the symptoms. The results of symptom improvement evaluations made by the patients immediately after the patients had treatments according to the Swing-Ishiguro method for the first time are as follows:

Significant improvement: 515 patients (22.6%)

Improvement: 909 patients (39.8%)

Slight improvement: 316 patients (13.8%)

No improvement: 542 patients (23.8%)

More than 75% of the 2282 patients showed some improvement immediately after they had been treated according to the Swing-Ishiguro method. Examples of the significant improvement case include a case that a patient who had not been able to stand on his or her own feet became able to walk without assistance, a case that a patient who had been in pain in the seated position and in the supine position became able to assume the seated position and the supine position with no pain, and a case that a patient who had had the difficulty in lifting his or her legs and had not been able to stand without bending his or her back became able to take a posture close to an upright posture. In addition to these cases, there was a case that, for a child who had had a lower back pain associated with idiopathic scoliosis, the X-ray conducted after the child had been treated according to the Swing-Ishiguro method showed improvement in Cobb angle. Further, the Swing-Ishiguro method provided improvement of the symptoms not only for patients who had complained of pain in their legs and hip, but also for some of patients who had complained of pain in their neck or shoulder.

[Recap]

The following will describe Example in the context of a left lateral decubitus position. The Example aims at placing an upper right leg in a lateral decubitus position on a stand (1), and then transitively extending the right leg backward with a sacral area supported with a sacrum support pad (2) to provide movement of a lower left sacroiliac joint (9*b*). The present invention is directed to a sacroiliac joint exercise assist device configured as described above.

Thus, various aspects of the present invention can be expressed as follows:

(1) An exercise assist device including: a member adapted to support a leg in a lateral decubitus position, the exercise assist device providing movement of a sacroiliac joint by extending the leg transitively.

(2) The exercise assist device described in (1), wherein the member is a stand, the leg is an upper leg of a human subject in a lateral decubitus position, and the stand is adapted to move toward a back of the human subject without exercise of voluntary muscles of the human subject.

(3) The exercise assist device described in (1) or (2), further including: a pad adapted to support a lumbar area of the human subject behind a back of the patient.

(4) The exercise assist device described in any one of (1) to (3), wherein the stand and the pad are disposed at respective free ends of two arms, the two arms extending from a strut, the strut extending in a direction substantially orthogonal to a body axis of the human subject.

(5) A method of improving movement of a sacroiliac joint, including: putting a human subject who assumes a lateral decubitus position by turning either side of his or her body on which the human subject has a discomfort downward through passive movement of his or her upper thigh from a certain position when the human subject is releasing tension of muscles to a position closer to a back of the human subject.

REFERENCE SIGNS LIST

1: Leg support stand (stand)
2: Sacrum support pad (pad)
3: Movable arm (arm)
4: Strut
5: Connection frame with respect to a wall surface
6: Sacrum
7*a*: Right iliac bone
7*b*: Left iliac bone
8*a*: Right thighbone
8*b*: Left thighbone
9*a*: Right sacroiliac joint
9*b*: Left sacroiliac joint
10*a*: Right hip joint
10*b*: Left hip joint

The invention claimed is:

1. An exercise assist device comprising:

a member adapted to support only an upper thigh out of both thighs of a human subject in a lateral decubitus position, the exercise assist device adapted to provide movement of a sacroiliac joint by extending a hip joint transitively, wherein:

the member is a stand, the stand is adapted to move toward a posterior direction of the human subject without exercise of voluntary muscles of the human subject, the exercise assist device further comprises a pad adapted to support a sacrum of the human subject behind a back of the human subject, wherein the pad is not fixed to a body of the human subject during use, and the sacroiliac joint is a lower sacroiliac joint.

2. The exercise assist device according to claim 1, wherein the stand and the pad are disposed at respective free ends of two arms, the two arms extending from a strut, the strut extending in a direction substantially orthogonal to a body axis of the human subject.

3. The exercise assist device according to claim 2, wherein the strut is fixed to a bed, a wall surface, or a ceiling.

4. The exercise assist device according to claim 1, wherein the stand lifts the upper thigh externally to a body axis of the human subject.

5. A method of improving movement of a sacroiliac joint, comprising:

supporting, by a stand of an exercise assist device, only an upper thigh out of both thighs of a human subject who assumes a lateral decubitus position by lying on a side of his or her body on which the human subject complains of pain or numbness so as to allow passive movement of only the upper thigh from a neutral position to a more posterior position of the human subject while the human subject releases tension in his or her muscles;

supporting, by a pad of the exercise assist device, a sacrum of the human subject behind a back of the human subject; and providing movement, by the exercise assist device, of a lower sacroiliac joint of the human subject to reduce pain or numbness of in the lower sacroiliac joint or the muscles.

* * * * *